US005372106A

United States Patent [19]

Botterill

[11] Patent Number: 5,372,106

[45] Date of Patent: Dec. 13, 1994

[54] DRIVE ASSEMBLY FOR AUXILIARY UNITS

[75] Inventor: John R. Botterill, Saarbrücken, Germany

[73] Assignee: GKN Automotive AG, Lohmar, Germany

[21] Appl. No.: 171,333

[22] Filed: Dec. 20, 1993

[30] Foreign Application Priority Data

Dec. 23, 1992 [DE] Germany ..... 4243777

[51] Int. Cl.[5] ..... F02B 77/00

[52] U.S. Cl. ..... 123/198 R; 192/3.52; 192/84 R; 475/293

[58] Field of Search ..... 123/198 R; 192/3.52, 192/84 R, 93 A; 475/254, 293

[56] References Cited

FOREIGN PATENT DOCUMENTS 57-5516 1/1982 Japan ..... 123/198 R
623711 9/1978 U.S.S.R. ..... 192/93 A

*Primary Examiner*—Noah P. Kamen
*Attorney, Agent, or Firm*—Harness, Dickey & Pierce

[57] ABSTRACT

A drive assembly for auxiliary units of an internal combustion engine of a motor vehicle, which may be mounted at an end wall of the internal combustion engine especially coaxially relative to the crankshaft, has two switchable gear stages between its input shaft, driven by the crankshaft and its output shaft, driving the auxiliary units. Gear changing is ejected by actuating a friction coupling. The friction coupling, in the connected condition, engages a direct gear and, in the disconnected condition, drives a reduction gear via a locking freewheeling device. An actuating assembly for the friction coupling includes adjusting discs which are held in a housing of the drive assembly so as to be arranged coaxially relative no the friction coupling and which are rotatable relative to one another. One of the adjusting discs, in the form of a supporting ring, is axially supported in the housing of the drive assembly. The other one, in the form of a pressure ring, is axially movable in the housing and acts on the friction coupling. At least two rolling members are guided in circumferentially directed ball grooves between the end faces of the adjusting discs facing one another. The depth of the ball grooves changes across the circumference in such a way that any rotation of the adjusting discs relative to one another results in a reciprocal axial displacement which is transferred to the friction coupling.

12 Claims, 3 Drawing Sheets

DRIVE ASSEMBLY FOR AUXILIARY UNITS

BACKGROUND OF THE INVENTION

The invention relates to a drive assembly for auxiliary units of an internal combustion engine of a motor vehicle. The units may be mounted at an end wall of the internal combustion engine, especially coaxially relative to the crankshaft. Two switchable gear stages are between the input shaft driven by the crankshaft and the output shaft driving the auxiliary units, with gear changing effected by actuating a friction coupling.

Drive assemblies of this type are known from EP 0 123 580 B1. It is the purpose of such assemblies to ensure that even close to the idling speed, the major auxiliary units, such as the water pump, generator, possibly the hydraulic pump for power steering and the air conditioning compressor are supplied with sufficient power, e.g. are driven at a relatively high speed, On the other hand, the assemblies ensure, at an increased engine speed for the purpose of reducing fuel consumption, the driving speed and thus the power consumption of the auxiliary units are reduced because, as compared to operating conditions close to the idling speed, the power requirements of the auxiliary units are not increased accordingly. On the contrary, it is sufficient in such cases to drive the auxiliary units at a speed which is reduced as compared to the engine speed. The planetary gear unit used in such cases is actuated by a solenoid integrated into the housing of the drive assembly, with a direct connection between the driveshaft and the drive assembly housing accommodating a pulley being effected in a power-less way by pressure springs.

Because the solenoid is integrated into the drive assembly housing, the entire assembly has to be replaced if the solenoid fails, as a result of which repair costs are very high. The assembly described is inadequately protected against the environment so that failure is likely to occur.

Furthermore, it is disadvantageous if, for the operating position itself, only one of the two gear stages requires power on a permanent basis. This applies in view of the fact that the electric system of motor vehicles has already reached its loading limits, which means that its own requirements partially destroy the justification for the expense of providing a two-gear drive assembly for the auxiliary units with the objective of saving energy.

SUMMARY OF THE INVENTION

It is therefore an object of the invention to provide an assembly of the above type which contributes towards the improvement of energy consumption, provides improved actuating mechanisms and provides a higher degree of reliability. In accordance with the invention, a friction coupling, in the connected condition, engages a direct gear and, in the disconnected condition, drives a reduction gear by means of a locking freewheeling device.

An actuating assembly for the friction coupling includes adjusting discs which are held in a housing of the drive assembly so as to be arranged coaxially relative to the friction coupling and which are rotatable relative to one another. One of said adjusting discs, in the form of a supporting ring, is axially supported in the housing of the drive assembly. The other one, in the form of a pressure ring, is axially movable in the housing and acts on the friction coupling. At least two rolling members are guided in circumferentially directed ball grooves between the end faces of the adjusting discs facing one another. The depth of the ball grooves changes across the circumference in such a way that any rotation of the adjusting discs relative to one another results in a reciprocal axial displacement which is transferred to the friction coupling.

An advantage of an assembly in accordance with the invention is there is no need for electrical energy. It is designed in a simple way and due to its simple mechanics, it is operationally safe. A simple method of supplying sprayed oil includes connecting the compressed oil supply with the circuit of lubricating oil of the internal combustion engine or providing an open passage leading to the crankshaft housing, so that high service life values can be achieved.

According to an advantageous embodiment, for the purpose of rotating one of the adjusting discs, the actuating assembly for the friction coupling includes an electric motor with a spring holding brake. When the electric motor reaches a preprogrammed power value which corresponds to the process of engaging the higher gear stage, the electric motor is disconnected from power, and, as a result, the spring holding brake enters the braking position which is also power-less.

The above-mentioned disconnection of the electric motor takes place when the direct gear is engaged after the coupling has been connected. When the coupling is disconnected for the purpose of engaging the reduction gear, the electric motor runs until the actuating assembly stops, especially until balls stop against the end of the ball tracks which will be described at a later stage.

The electric drive proposed by the invention may be based on simple electric motors used and proven in motor vehicle design. The holding brake ensures zero power consumption in operation.

The gear changing operation is controlled by operating parameters known in themselves, especially by the motor speed. Other influencing factors may be used for control purposes.

According to a first embodiment of the actuating device, the switchable gear stages are formed by a planetary gear unit whose sun gear is non-rotatingly connected to the input shaft. A planetary carrier is freely rotatable on the input shaft, with the planetary gears rolling in a hollow gear inserted into the housing. A coupling housing connectable to the planetary carrier by means of a freewheeling unit is non-rotatingly connected to the output shaft and, when the friction coupling is disengaged, non-rotatingly connects the planetary carrier to the output shaft. When the friction coupling is engaged, the input shaft is non-rotatingly connected to the output shaft. It is possible to ensure that the adjusting discs and the rolling members are kept in constant axial contact by a spring assembly.

Further details of the invention include a first coupling half formed by a coupling housing or a pressure plate which is axially movable and includes a radial face which may be loaded by the actuating assembly. A second coupling half formed accordingly by a pressure plate or coupling housing is axially supported in the housing.

According to a first design of the actuating device, the supporting disc is non-rotatingly held in the housing with the adjusting disc being rotatable and axially movable relative to the supporting disc and the housing. According to an alternative design of the actuating device, the supporting disc is rotatable in the housing and is axially supported on a further supporting disc held in the housing with the adjusting disc being non-rotatingly and axially movably guided in the housing. An increased service life may be achieved in that, to ensure the supply of lubricating oil, the housing for the drive assembly is permanently connected to the interior of the internal combustion engine.

According to an advantageous, space-saving design, the electric motor is arranged such that it is enclosed between the free ends of the belt driven by the disc. A drive assembly of this type can be used for mass production purposes without especially modifying the design of the internal combustion engine. In particular, it may be used as an option for consumption-optimized vehicles or for vehicles whose auxiliary units are characterised by high power requirements. If the disc for driving the auxiliary units includes a dish-shaped hub connected to the output shaft, the disc is positioned at a distance from and in front of the end wall of the internal combustion engine. The distance corresponds to that of a disc used entirely for directly driving the standard auxiliary units.

The assembly in accordance with the invention is switched in a noise- and impact-free way by using an adapted electronic control system of the actuating electric motor so that comfort is not disadvantageously affected.

From the following detailed description taken in conjunction with the accompanying drawings and subjoined claims, other objects and advantages of the present invention will become apparent to those skilled in the art.

BRIEF DESCRIPTION OF THE DRAWINGS

Preferred embodiments of the invention will be described below with reference to the drawings wherein.

DETAILED DESCRIPTION OF THE PREFERRED EMBODIMENTS

Figure 1A:
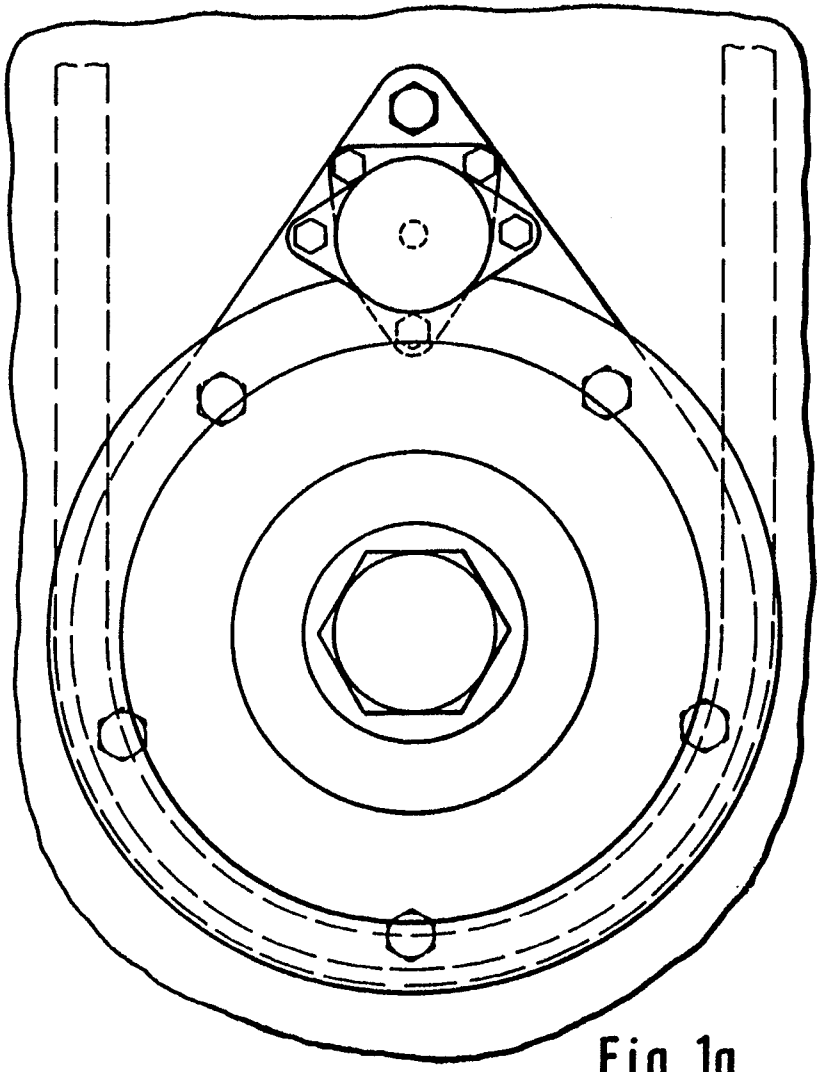
FIG. 1*a* is an axial plan view in the direction of arrow A in A—A of FIG. 1.
Figure 1:
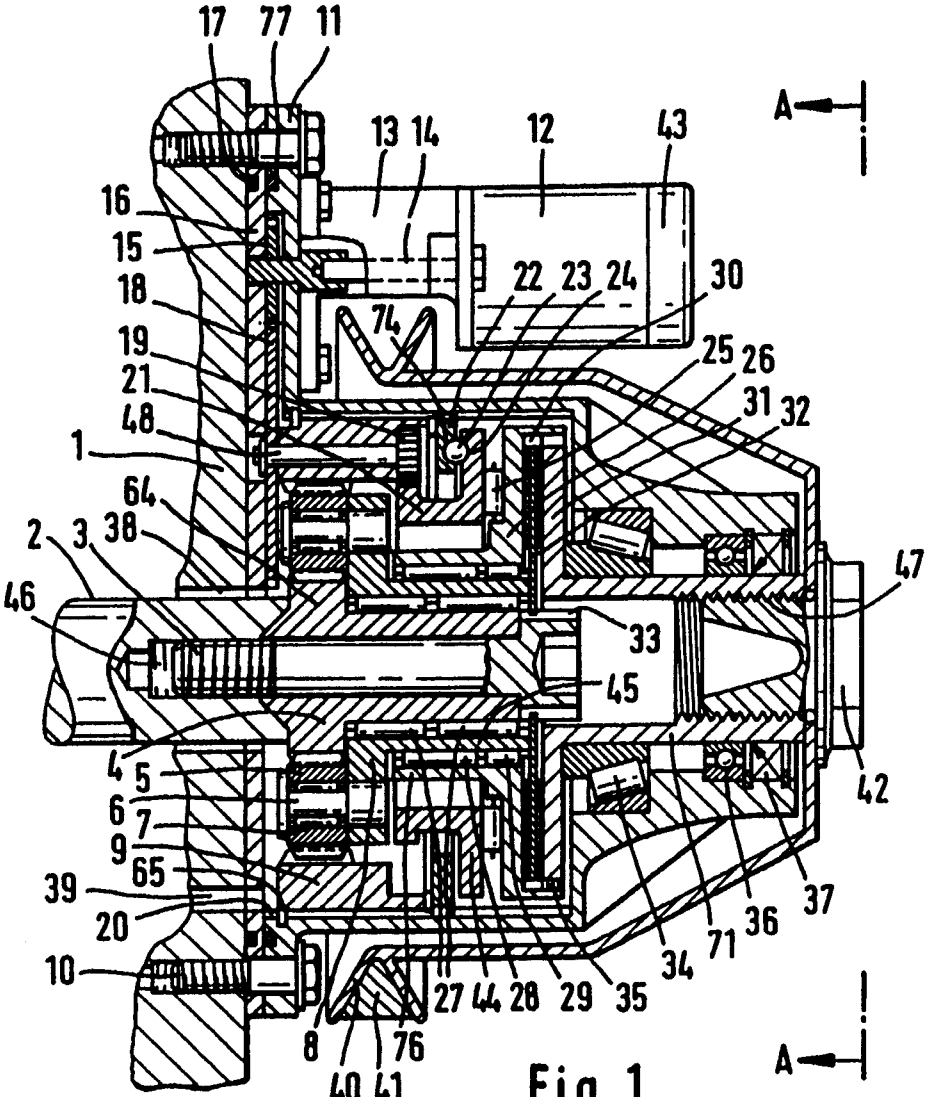
FIG. 1 is a longitudinal sectional view of a first embodiment of an assembly in accordance with the invention.

FIG. 1, in accordance with the invention, shows a drive assembly for auxiliary units with two gear stages. The assembly is bolted to an end wall 1 of a crankshaft housing of an internal combustion engine. The drive assembly includes a housing 11 which, by bolts 10, is bolted to the end wall 1 of the crankshaft housing, with an intermediate plate 16 inserted therebetween. Seals 17, 77 are provided between the end wall 1 and the intermediate plate 16 and between the intermediate plate 16 and the housing 11. The free end of the crankshaft 2 of the internal combustion engine extends through the end wall 1 and is provided with a coaxial threaded bore. An input shaft 4 of the drive assembly with a sun gear 64 is non-rotatingly connected to the crankshaft end 2 by means of a bolt 3. A planetary carrier 8 is rotatably supported on the input shaft 4 by means of two needle bearings 27. The carrier 8 carries a plurality of planetary gears 5 which are secured to uniformly circumferentially distributed journals 6 at the planetary carrier 8, with needle bearings 7 being provided for supporting purposes. The planetary gears 5 permanently engage the sun gear 64 and the ring gear 9. The ring gear 9 is non-rotatingly held in guiding means 20 in the housing 11 of the drive assembly and axially secured by a securing ring 65.

A sleeve-shaped projection 76 of a coupling housing 26 of a friction coupling is held by a needle bearing 29 on a sleeve-shaped projection 45 of the planetary carrier 8. In addition to the needle bearing 29, a freewheeling unit 28 is provided between the projection 76 of the coupling housing 26 and the projection 45 of the planetary carrier 8. This enables the coupling housing 26 to be driven by the planetary carrier 8 when the friction coupling is open.

At least one coupling plate 32, which may be covered on botch sides by a friction material, is non-rotatingly and axially movably secured in teeth 33 at the head of the bolt 3. It is thus rotatably connected to the crankshaft end 2.

The coupling housing 26 axially movably engages a coupling counterplate 31 by means of axial teeth 30. The coupling counterplate 31 is connected to an output shaft 71 so as to be integral therewith. The output shaft 71 is supported in the housing 11 by rolling contact bearings 34, 36. Between the housing 11 and the end of the output shaft 71 there is provided a seal 37. The end of the output shaft 71 holds a threaded bolt 42 securing a belt pulley 40 driving a cone or V belt 41. The pulley 40 includes a deep-drawn, dish-like hub 49 which extends over the housing 11. Both the thread 47 between the bolt 42 and the output shaft 31 and the thread 46 between the input shaft 4 and the crankshaft end 2 extend in the direction opposite to the direction of rotation of the crankshaft. Normally, if the crankshaft rotates clockwise as shown in FIG. 1A, the thread is a left-hand thread.

An electric motor 12 is bolted to the housing 11 by means of a spacer 13. At the opposite end, there is provided a spring holding brake 43 which is able to stop the electric motor when it is disconnected from power. A pinion 15 positioned on the shaft 14 of the electric motor engages a gear 18. The motor shaft 14 is preferably supported in the intermediate plate 16. The gear 18 is secured to a shaft 48 whose opposite end carries a further pinion 19. The shaft 48 is supported in the ring gear 9 firmly inserted into the housing.

The drive assembly is preferably lubricated with oil coming from the crankshaft housing of the internal combustion engine. Oil spray is to be transferred from an annular gap 38 at the end of the crankshaft. For this purpose, the seal at the end of the crankshaft may be removed. There is provided an oil return bore 39 which is closed by a sealing bolt if a drive assembly is not attached.

FIG. 1 shows an actuating assembly for the friction coupling 26 in the case of which a gear 21 engages the pinion 19 designed to be integral with the rotatable expanding ring 44. In the space between the pinion 19 and the expanding ring 44 a supporting ring 22 is provided which is inserted into the housing 11 so as to be non-rotating and axially fixed. The end faces of the expanding ring 44 and supporting ring 22 facing one another are provided with at least three balls 23 positioned in circumferentially extending grooves 24, 74 whose depth varies. The shape of the ball grooves 24 in the expanding ring 44 is shown in greater detail in FIG. 3. The ball grooves 74 in the supporting ring 22 have the same shape, but rise in opposite directions. Between the coupling housing 26 and the coupling counterplate 31 there is inserted a plurality of circumferentially distributed axial pressure springs 35 which, via an axial bearing 25, act on the expanding rings 44, thereby holding the expanding ring 44 and the supporting ring 22 in constant contact with the balls 23.

Figure 2:
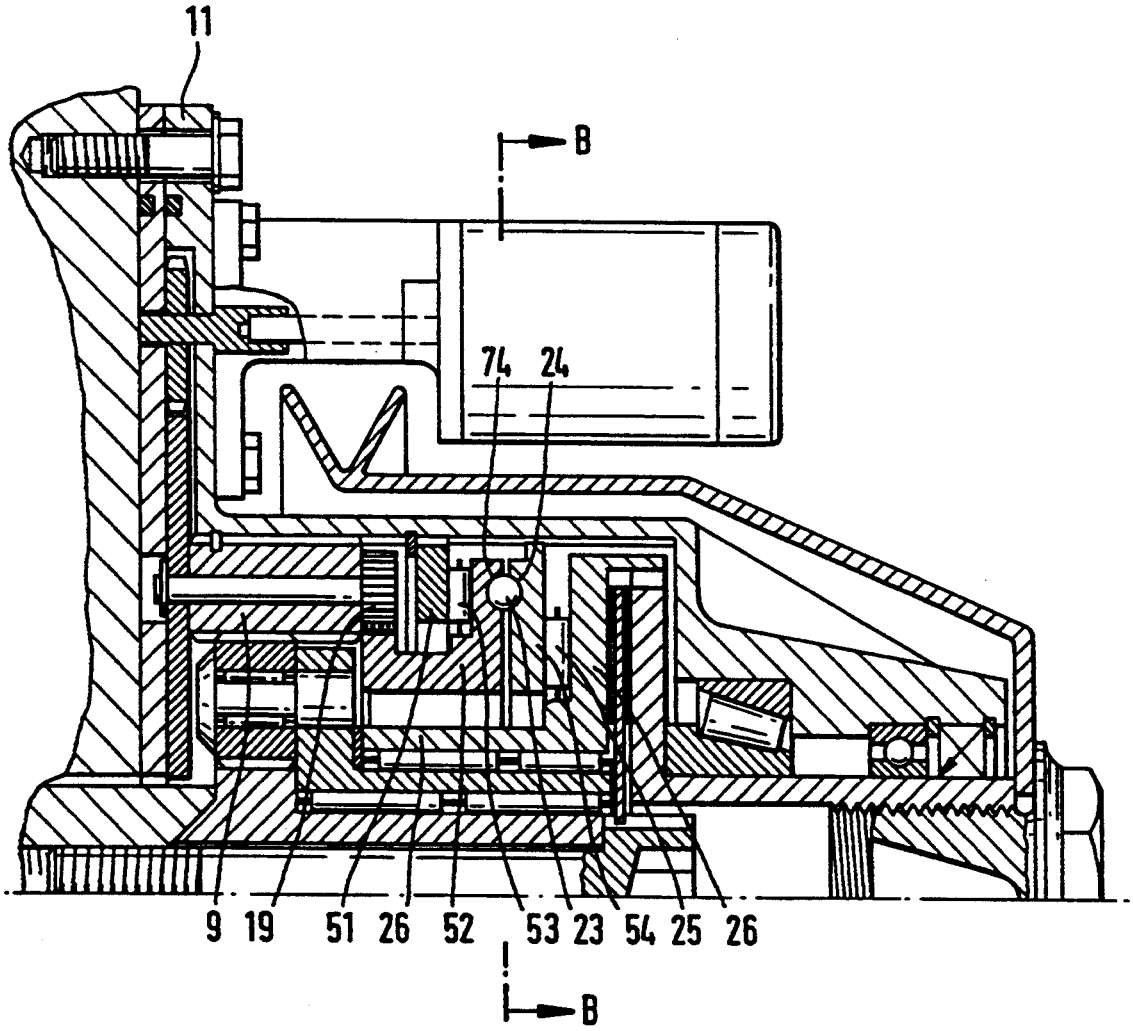
FIG. 2 is a longitudinal sectional view of a second embodiment of an assembly in accordance with the invention.

FIG. 2 shows the above-described actuating assembly in a modified embodiment. Only those details which differ from FIG. 1 are given reference numbers and are described below. A rotatable supporting ring 52, by means of an axial bearing 53, is supported on a further supporting ring 51 inserted into the housing 11 so as to be non-rotating and axially fixed. The supporting ring 52 cooperates with a pressure ring 54 by means of balls 23 held in the ball grooves 24, 74. The pressure ring 54 is non-rotatingly and axially movably held in the housing 11 and, by means of an axial bearing 25, acts on the coupling housing 26. The advantage of this assembly as compared to that shown in FIG. 1 consists in that there is no sliding friction in the teeth between the parts 19, 52, a feature which improves movability. A minor drawback is a larger number of components and the assembly is longer.

Figure 3:
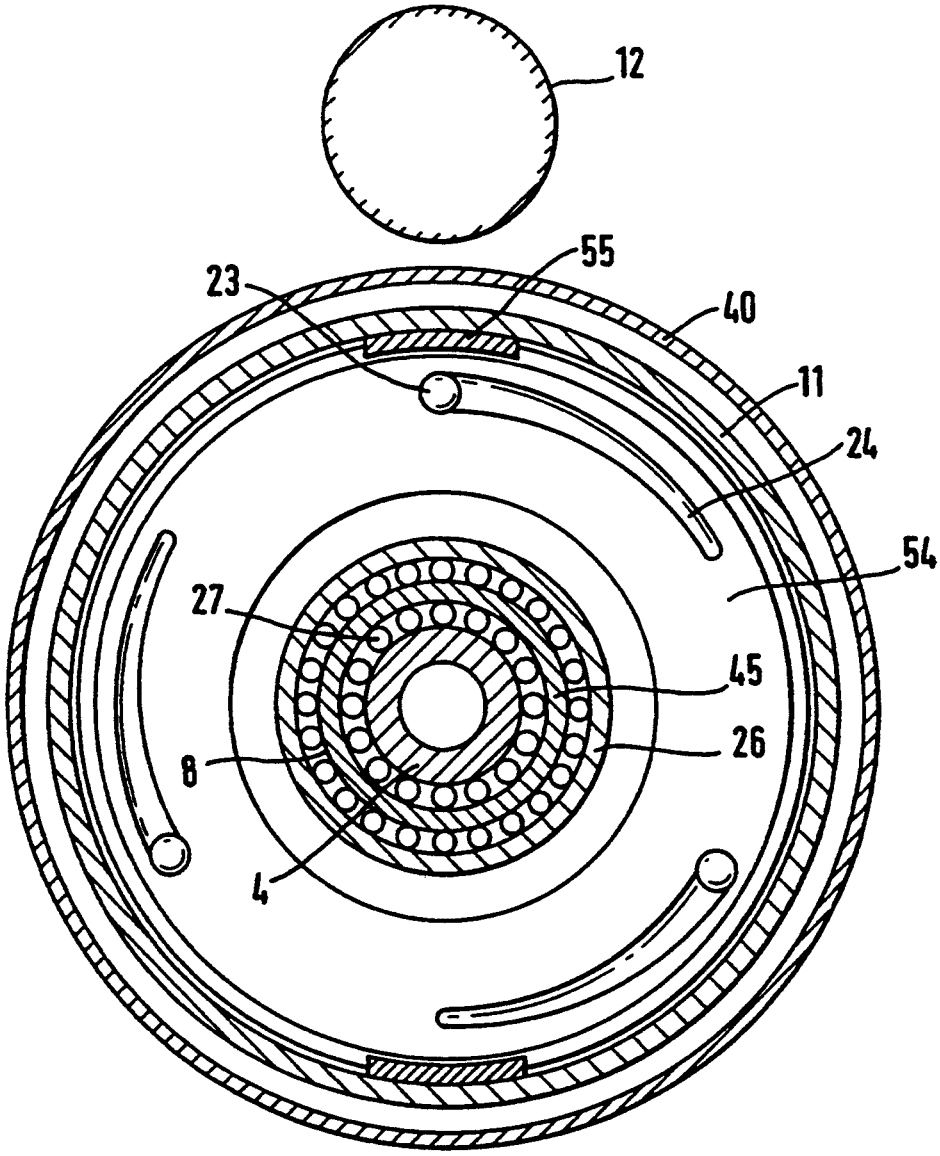
FIG. 3 is a plan view of an adjusting disc according to line B—B of FIG. 2.

In FIG. 3, any parts corresponding to those shown in FIGS. 1 and 2 have been given the same reference numbers and will not be described in detail. FIG. 3 shows the cross-section B—B according to FIG. 2. It shows the design of the ball grooves 24 having three balls 23 and anti-rotation means 55 acting for the pressure ring 54 relative to the housing 11. The same anti-rotation means also engage the ring gear 9 positioned in a different plane.

Below, the functioning of the embodiments according to FIGS. 1 and 2 will be described once again. By rotating the electric motor and thus the gear 21 and as a result of the shape of the ball grooves, the respective pressure ring 44, 54 is displaced towards the right. By means of the pressure bearing 25 and the coupling housing 26, an axial force acting against the axially fixed coupling counterplate 31 is built up in the coupling plate 32. The coupling plate 32 is axially movably and non-rotatingly guided in the teeth 33 of the bolt head 3. As a result, torque is transmitted directly from the crankshaft end 2 to the output shaft 71 and thus to the belt pulley 40. By generating such a friction locking effect, the coupling housing 26 is driven at a higher speed than the planetary carries 8. The freewheeling unit 28 is provided to permit such a relative speed. After a predetermined axial force has been reached between the coupling housing 26 and the coupling counterplate 31 of the output shaft 71, the electric motor 12 and the coil of the spring holding brake 41 are disconnected, which results in the braking effect of the spring holding brake 43, and the respective pressure ring 44, 54 remains in a pretensioned position relative to the coupling counterplate 31.

When reversing the current in the electric motor 12 while simultaneously applying current to the coil of the spring holding brake 43, the pressure ring 44, 54, in an electronically modulated way, is returned to a zero position stop as illustrated in FIG. 3. While disengaging the pressure ring 44, 54, an increasing amount of slip is generated at the coupling plate 32. The speed of the pressure ring 44, 54 is reduced to the lower speed of the planetary carrier 8. The freewheeling unit 28 new causes torque to be transmitted from the planetary carrier 8 to the coupling housing 26, thereby interrupting direct drive from the crankshaft end 2 to the output shaft 71. With power flow being effected by the planetary gear unit with a reduced speed, by the sun gear 64, the planetary gears 6, which are supported on the ring gear 9, drive the planetary carrier 8, and from there via the freewheeling unit 28 to the coupling housing 26. As a result, the drive is changed over to its reduction gear.

While the above detailed description describes the preferred embodiment of the present invention, the invention is susceptible to modification, variation, and alteration without deviating from the scope and fair meaning of the subjoined claims.

I claim:

1. A drive assembly for auxiliary units of an internal combustion engine of a motor vehicle, to be mounted at an end wall of the internal combustion engine, coaxially relative to its crankshaft, said drive assembly comprising:

two switchable gear stages between an input shaft, driven by the crankshaft, and an output shaft, driving the auxiliary units, with gear changing being effected by actuating a friction coupling;

said friction coupling, in a connected condition, engaging a direct gear and, in a disconnected condition, driving a reduction gear by means of a locking freewheeling device;

an actuating assembly for said friction coupling including adjusting discs which are held in a housing of the drive assembly so as to be arranged coaxially relative to the friction coupling and which are rotatable relative to one another, one of said adjusting discs, in the form of a supporting ring, being axially supported in the housing of the drive assembly and the other one, in the form of a pressure ring, being axially movable in the housing and acting on the friction coupling;

at least two rolling members guided in circumferentially directed ball grooves between end faces of the adjusting discs facing one another; and the depth of the ball grooves changes along the circumference such that any rotation of the adjusting discs relative to one another results in a relative axial displacement which is transferred to the friction coupling.

2. A drive assembly according to claim 1, wherein for the purpose of rotating one of the adjusting discs, the actuating assembly for the friction coupling includes an electric motor with a spring holding brake and, when the higher gear stage is reached, the electric motor is disconnected from power, and the spring holding brake enters the braking position, when the electric motor is disconnected from power.

3. A drive assembly according to claim 2, wherein the electric motor is removably flanged to the outside of the housing for the drive assembly.

4. A drive assembly according to claim 1, wherein the switchable gear stages are formed by a planetary gear unit whose sun gear is non-rotatingly connected to the input shaft;

a planetary carrier is freely rotatable on the input shaft, with the planetary gears rolling in a ring gear inserted into the housing;

a coupling housing of said friction coupling connectable to the planetary carrier by means of a freewheeling unit is non-rotatingly connected to the output shaft and, when the friction coupling is disengaged, non-rotatingly connects the planetary carrier to the output shaft; and when the friction coupling is engaged, the input shaft is non-rotatingly connected to the output shaft.

5. A drive assembly according to claim 4, wherein a first coupling half of said friction coupling is axially movable and includes a radial face which may be loaded by the actuating assembly.

6. A drive assembly according to claim 1, wherein the supporting disc is non-rotatingly held in the housing and that the adjusting disc is rotatable and axially movable relative to the supporting disc and the housing.

7. A drive assembly according to claim 1, wherein the supporting disc is rotatable in the housing and is axially supported on a further supporting disc held in the housing and that the adjusting disc is non-rotatingly and axially movably guided in the housing.

8. A drive assembly according to claim 1, wherein the adjusting discs and the rolling members are permanently held in axial contact by means of a spring assembly.

9. A drive assembly according to claim 1, wherein the interior of the housing of the drive assembly is permanently supplied with a lubricating oil from the crankshaft housing of the internal combustion engine.

10. A drive assembly according to claim 1, wherein for the purpose of being supplied with a lubricating oil, the housing for the drive assembly is permanently connected to the interior of the internal combustion engine.

11. A drive assembly according to claim 1, wherein a disc for driving the auxiliary units includes a dish-shaped hub which is non-rotatingly connected to the output shaft, the driving rim of said disc being positioned directly in front of the end wall of the internal combustion engine.

12. A drive assembly according to claim 11, wherein the disc is a pulley, especially a V-belt pulley or a toothed belt pulley and that the electric motor is arranged in such a way that it is enclosed between the free ends of the belt driven by the disc.

* * * * *

UNITED STATES PATENT AND TRADEMARK OFFICE

CERTIFICATE OF CORRECTION

PATENT NO. : 5,372,106

DATED : December 13, 1994

INVENTOR(S) : John Botterill

It is certified that error appears in the above-indentified patent and that said Letters Patent is hereby corrected as shown below:

In the Abstract, line 7, "ejected" should be --effected--

In the Abstract, line 14, "no" should be --to--

Column 1, line 19, "speed," should be --speed.--

Column 4, line 17, "botch" should be --both--

Column 5, line 48, "carries" should be --carrier--

Column 5, line 65, "new" should be --now--

Signed and Sealed this

Twentieth Day of June, 1995

*Attest:*

Bruce Lehman

BRUCE LEHMAN

*Attesting Officer*

*Commissioner of Patents and Trademarks*